US006786778B2

(12) United States Patent
Lai

(10) Patent No.: US 6,786,778 B2
(45) Date of Patent: Sep. 7, 2004

(54) ELECTRICAL CONNECTOR

(75) Inventor: Chin Te Lai, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/418,431

(22) Filed: Apr. 18, 2003

(65) Prior Publication Data

US 2004/0147171 A1 Jul. 29, 2004

(30) Foreign Application Priority Data

Jan. 29, 2003 (TW) ..... 92201642 U

(51) Int. Cl.[7] ..... H01R 17/18
(52) U.S. Cl. ..... 439/701; 439/668; 439/740
(58) Field of Search ..... 439/701, 688, 439/669, 740

(56) References Cited

U.S. PATENT DOCUMENTS 3,031,639 A * 4/1962 Majewski ..... 439/740
4,008,941 A * 2/1977 Smith ..... 439/358
4,986,764 A * 1/1991 Eaby et al. ..... 439/275
5,253,316 A * 10/1993 Shibutani et al. ..... 385/78
5,454,734 A * 10/1995 Eggert et al. ..... 439/578
5,676,565 A * 10/1997 Vagnoni ..... 439/580
5,938,478 A * 8/1999 Werner ..... 439/668
6,250,817 B1 * 6/2001 Lampert et al. ..... 385/56

FOREIGN PATENT DOCUMENTS

TW 406884 9/2000

* cited by examiner

*Primary Examiner*—Neil Abrams
(74) *Attorney, Agent, or Firm*—Wei Te Chung

(57) ABSTRACT

An electrical connector (100) includes a housing (11), a number of contacts (12), and an audio plug (22). The housing has a number of passageways (113) and a receiving cavity (117) therein, and a first limiting member (118) and a second limiting member (119) formed in the receiving cavity. The contacts are received in the passageways. The audio plug is removably received in the receiving cavity. The audio plug has a mating portion (221), a first retaining member (222) extending from the mating portion and engaging with the first limiting member (118) for preventing the audio plug from moving along the axis thereof, a rear portion (223) opposite to the mating portion, and a second retaining member or rib (224) formed in a direction perpendicular to the axis of the audio plug and engaging with the second limiting member (119) for preventing the audio plug from turning around on the axis thereof.

13 Claims, 7 Drawing Sheets

ELECTRICAL CONNECTOR

BACKGROUND OF THE INVENTION

1. Field of the Invention

The present invention relates to an electrical connector, and more particularly to a plug connector transmitting both audio signals and other signals.

2. Description of Prior Art

Plug and jack type connectors are well known for use in connecting audio equipments. The plugs and jacks only transmit audio signals in an earlier stage. Later on, a few individual contacts are provided on a plug connector to transmit other signals. Taiwan patent issue No. 406884 discloses such a plug connector transmitting both audio signals and other signals. The plug connector includes an audio plug, a plurality of contacts disposed adjacent to the audio plug, and an insulative housing enclosing the audio plug and the contacts. Rear ends of the audio plug and the contacts of the plug connector are to be connected to wires of a cable. However, since the audio plug and the contacts are insert-molded in the housing, if either the audio plug or the contacts is damaged or tested to be incapable of electrical transmission, the audio plug and the contacts can not be reworked or replaced individually and the whole plug connector has to be discarded, which is obviously undersirable for manufacturers.

Hence, an improved plug connector is required to overcome the disadvantages of the prior art.

SUMMARY OF THE INVENTION

A major object of the present invention is to provide an easily reworkable electrical connector.

In order to achieve the object set forth, an electrical connector comprises a housing, a plurality of contacts, and an audio plug. The housing comprises a first portion and a second portion. The first portion defines a plurality of passageways extending therethrough. The second portion is arranged parallel to the first portion and comprises a receiving cavity therein, a first limiting member and a second limiting member formed in the receiving cavity. The plurality of contacts are received in the passageways of the first portion and each has a contacting portion and a tail portion extending from the contacting portion. The audio plug is received in the receiving cavity of the second portion and has a mating portion, a first retaining member extending from the mating portion and engaging with the first limiting member, a rear portion opposite to the mating portion, and a second retaining member extending in a direction perpendicular to the axis of the audio plug and engaging with the second limiting member. In addition, an angle is formed between the perpendicular bisector of the second limiting member and the direction along which the second retaining member extending when the audio plug is initially inserted into the receiving cavity.

Other objects, advantages and novel features of the invention will become more apparent from the following detailed description when taken in conjunction with the accompanying drawings.

DETAILED DESCRIPTION OF THE INVENTION

Figure 1:
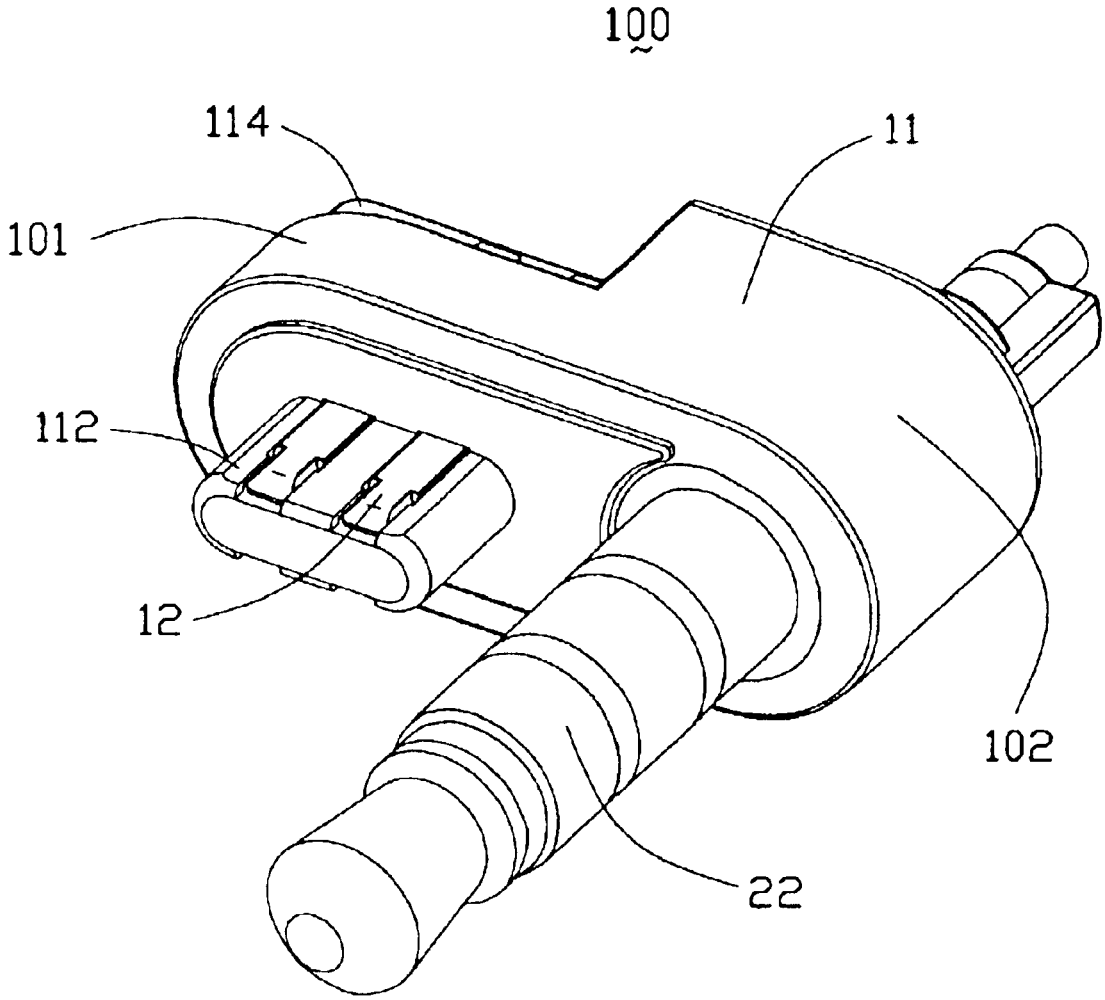
FIG. 1 is a perspective view of an electrical connector in accordance with the present invention.
Figure 2:
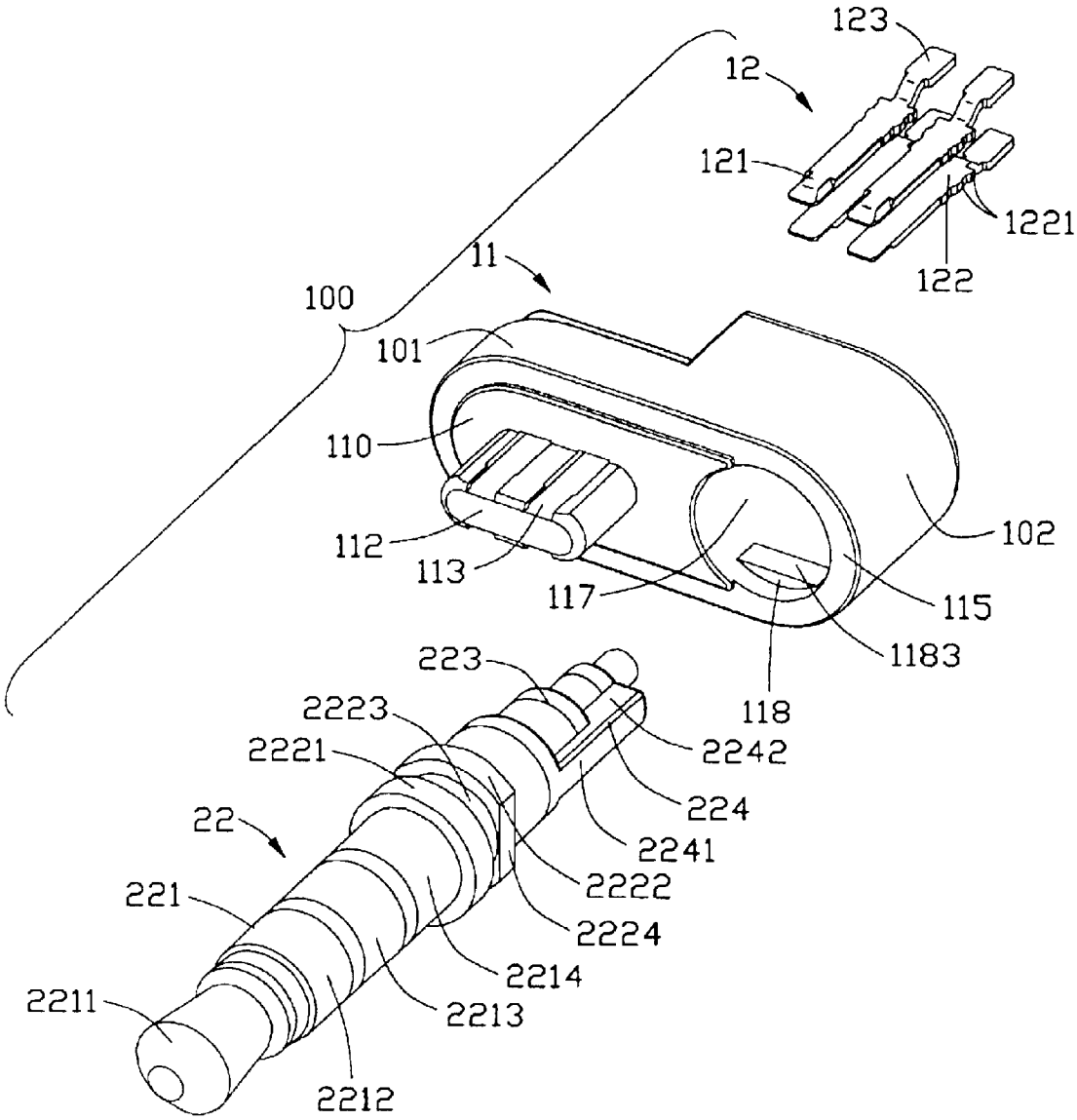
FIG. 2 is an exploded, perspective view of the electrical connector of FIG. 1.
Figure 3:
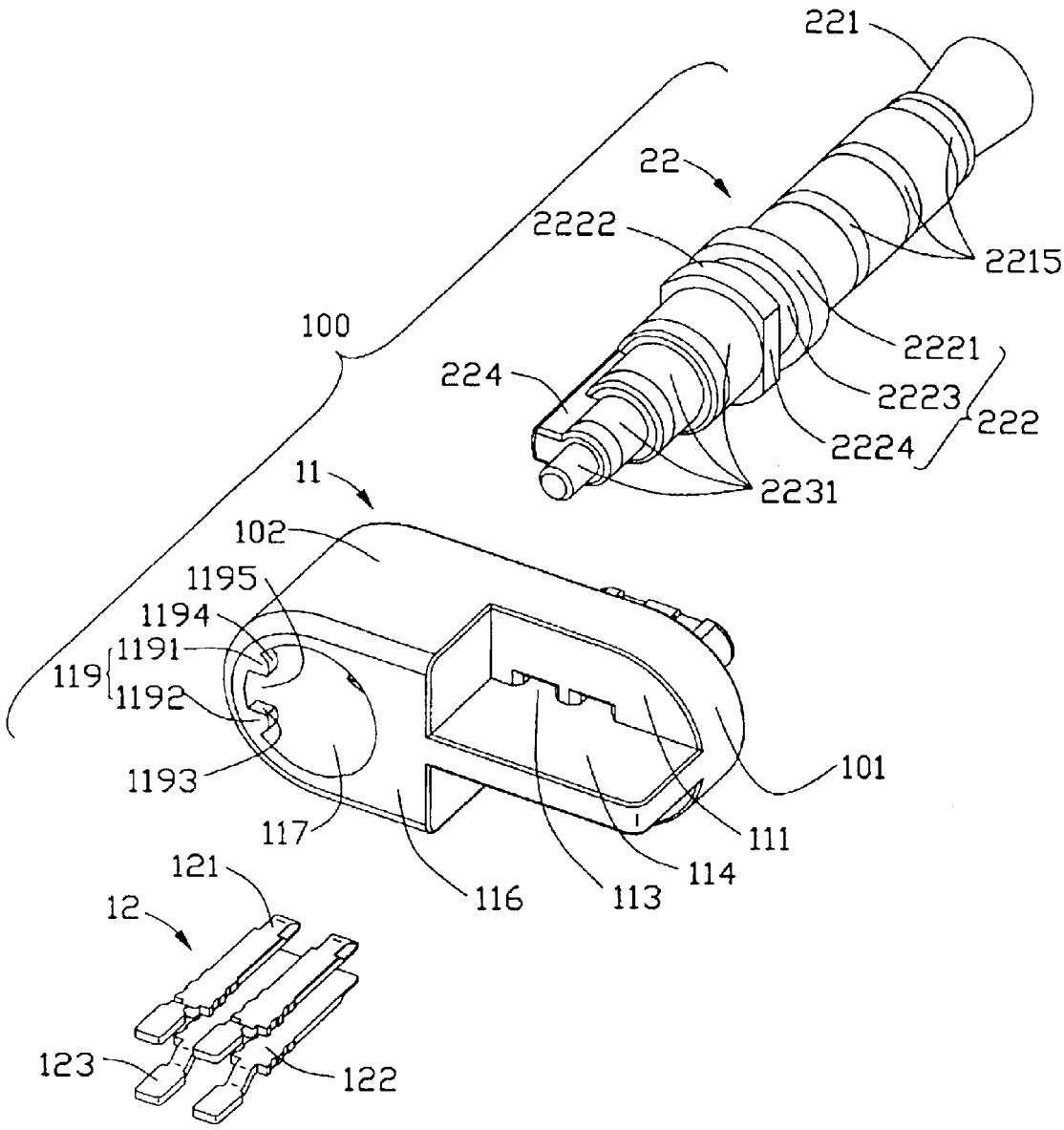
FIG. 3 is an exploded, perspective view of the electrical connector of FIG. 1 from a different aspect.

Referring to FIGS. 1 to 3, an electrical connector 100 in accordance with the present invention comprises an insulative housing 11, four electrical contacts 12 received in the housing 11, and an audio plug 22 received in the housing 11 for transmitting audio signals.

The housing 11 is configured by a first portion 101 and a second portion 102 side by side. The first portion 101 comprises a front face 110, a rear face 111, a tongue plate 112 extending forwardly from the front face 110, and a generally rectangular board 114 extending rearwardly from the rear face 111. The tongue plate 112 defines four passageways 113 arranged symmetrically on opposite upper and lower faces thereof and extending rearwardly through the rear face 111 of the first portion 101. The board 114 extends from the middle of the rear face 111 between the upper and the lower passageways 113.

The second portion 102 comprises a front face 115 flush with the front face 110 of the first portion 101, an opposite rear face 116 flush with a rear face of the board 114 of the first portion 101, a cylindrical receiving cavity 117 extending through the front face 115 and the rear face 116, and a first and a second limiting members 118, 119 projecting into the receiving cavity 117. In this embodiment, the first limiting member 118 includes two projections 1181, 1182 oppositely projecting into the receiving cavity 117 from inner surface of the receiving cavity 117 adjacent to the front face 115. Each projection 1181 (1182) has a planar surface 1183. The second limiting member 119 is formed adjacent to the rear face 116. In this embodiment, the second limiting member 119 comprises two thumb-shaped protrusions 1191, 1192 projecting into the cavity 117 from inner surface of the receiving cavity 117, and a space 1195 therebetween. Each thumb-shaped protrusion 1191 (1192) has a planar surface 1193 facing toward the other protrusion 1192 (1191) and an arc surface 1194 away from the other protrusion 1192 (1191).

The four contacts 12 are received in corresponding passageways 113 of the tongue plate 112. Each contact 12 includes a contacting portion 121 for electrically contacting with a corresponding contact of a complementally connector (not shown), a connecting portion 122 extending rearwardly from the contacting portion 121, and a tail portion 123 extending first obliquely from the connecting portion 122 and then flatly for electrically connecting with a corresponding wire of a cable (not shown). The connecting portion 122 is formed with a plurality of barbs 1221 on opposite sides thereof. The contacts 12 are inserted into the corresponding passageways 113 along a rear-to-front direction. The barbs 1221 interfere with opposite walls of corresponding passageways 113. The contacting portions 121 are received in the corresponding passageways 113. The tail portions 123 project out of the rear face 111 beside upper and lower faces of the board 114.

The audio plug 22 includes a mating portion 221 at a front end thereof for electrically connecting with a corresponding contact of the complementally connector, a rear portion 223 at a rear end thereof for electrically connecting with a corresponding wire of the cable, a first retaining member 222 disposed between the mating portion 221 and the rear portion 223, and a second retaining member 224 formed on the rear portion 223. The mating portion 221 has a metallic contact tip 2211, a plurality of annular metallic tubes 2212, 2213, 2214 and a plurality of insulating rings 2215 between the contact tip 2211 and the metallic tube 2212 and between the metallic tubes 2212, 2213, 2214.

In this embodiment, the first retaining member 222 includes an annular first projecting loop 2221 and a substantially annular second projecting loop 2222. The first and the second projecting loops 2221, 2222 define a groove 2223 therebetween. It should be noted that the two projecting loops 2221, 2222 have a same diameter. The width of the groove 2223 substantially equals to the width of either of the projection 1181 and 1182 of the first limiting member 118. Two opposite sides of the second projecting loop 2222 are cut out to define two planar surfaces 2224 thereon, and the distance between the two planar surface 2224 equals to the distance between the two planar surface 1183 of the two projections 1181 and 1182 of the first limiting member 118.

The rear portion 223 is formed with four cylindrical portions 2231 along the axis of the audio plug 22 in the front-to-rear direction. In this embodiment, the second retaining member 224 includes a rib 224 projecting sidewardly from outersurfaces of the cylindrical portions 2231. The rib 224 has an outer face 2241 flush with an outer face of the front most cylindrical portion 2231 of the rear portion 223 and two opposite planar side faces 2242 connected by the outer face 2241. The distance between the two side faces 2242 substantially equals to the distance between the two planar surfaces 1193 of the two thumb-shaped protrusions 1191, 1192 of the second limiting member 119. In addition, a plane in which the rib 224 is located is perpendicular to a plane in which the second projecting loop 2222 is located and is perpendicular to a plane in which the surface 2224 extends.

Figure 4:
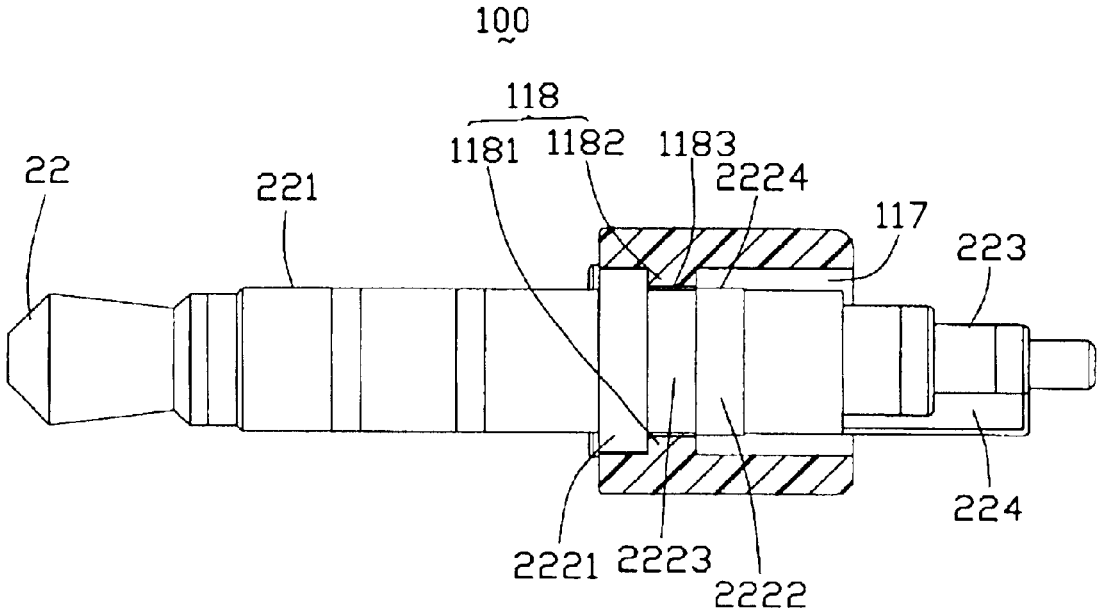
FIG. 4 is a partially cross-sectional view of the electrical connector of FIG. 1, showing an audio plug initially received in an insulative housing thereof.
Figure 5:
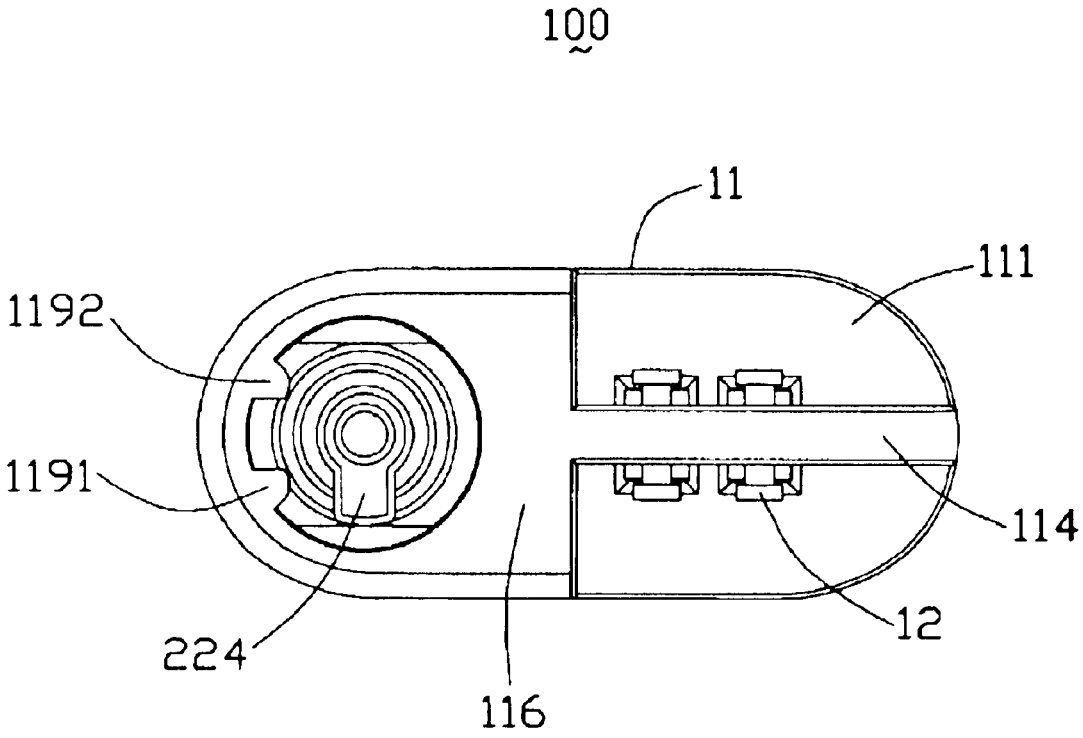
FIG. 5 is a rear view of FIG. 4.

Referring to FIGS. 4 and 5, the audio plug 22 is initially inserted into the receiving cavity 117 of the second portion 102 along a front-to-rear direction in such a way that the planar surface 2224 of the second projecting loop 2222 is parallel to the planar surface 1183 of each projection 1181, 1182. Since the first projecting loop 2221 is completely annular shaped, the loop 2221 can not pass through the space between the planar surfaces 1183 of two projections 1181, 1182. When the first projecting loops 2221 press against two projections 1181, 1182, the audio plug 22 can not move rearwardly any more. In such a situation, the direction along which the second retaining member extends is perpendicular to the perpendicular bisector of the second limiting member 119.

Figure 6:
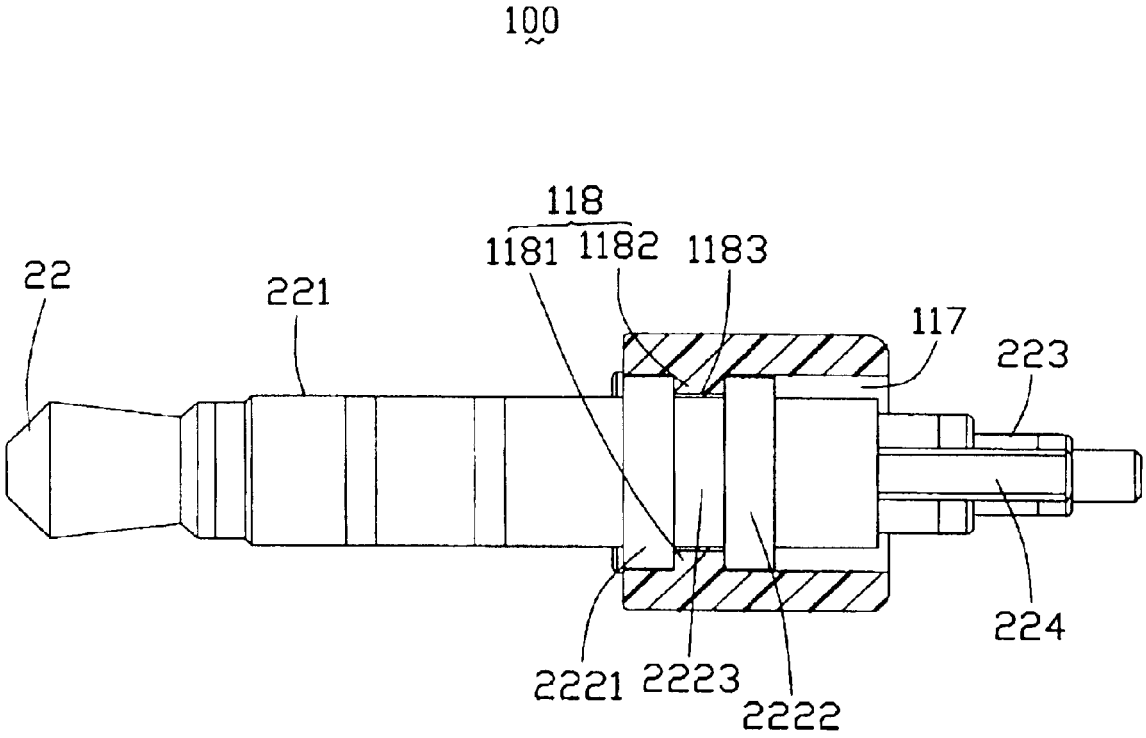
FIG. 6 is a view similar to FIG. 4, but the audio plug has been finally assembled with the insulative housing.
Figure 7:
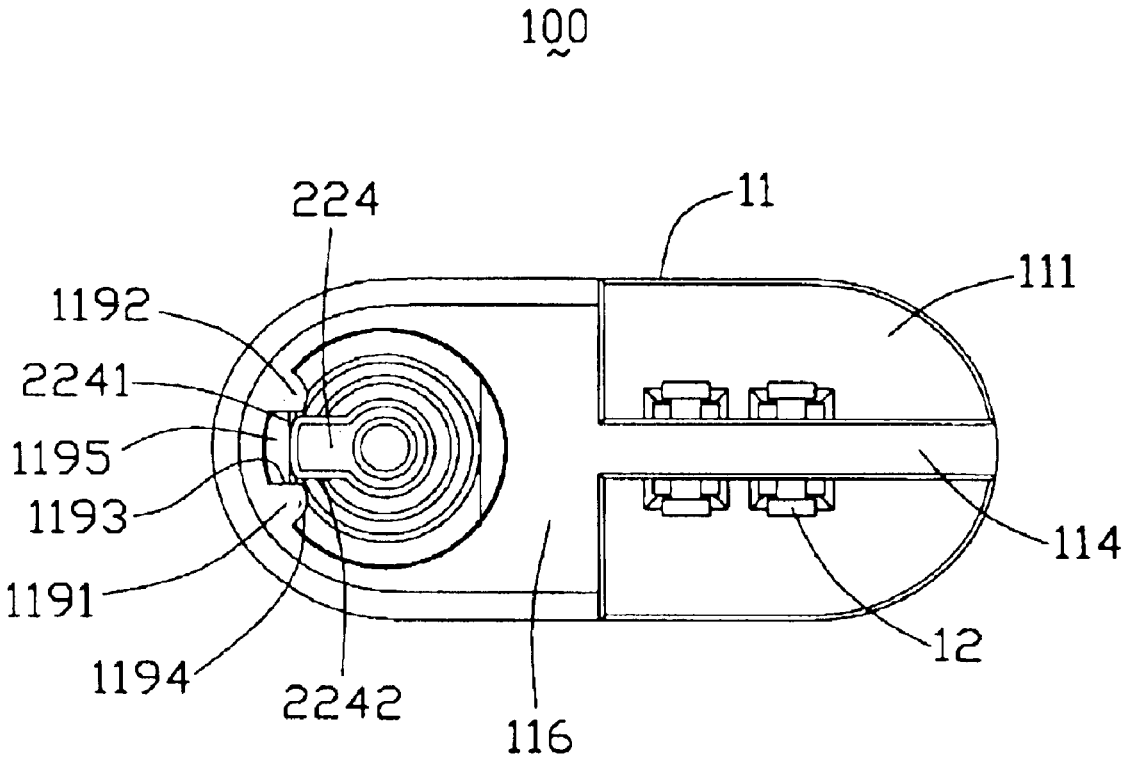
FIG. 7 is a rear view of FIG. 6.

Referring to FIG. 6, the audio plug 22 is then rotated clockwise from the rear view. The two projections 1181, 1182 of the first limiting member 118 are both received or snapped into the groove 2223, and the two projecting loops 2221, 2222 abut against two side faces of the projections 1181, 1182 respectively to prevent the audio plug 22 from moving along the axis of the audio plug 22. Referring to FIG. 7, the second retaining member 224 is positioned in the space 1195 between the two thumb-shaped protrusions 1191, 1192 of the second limiting member 119 by leading of the face 2241 of the rib 224 and the arc surface 1194 of the thumb-shaped protrusions 1191, 1192.

Because two side faces 2242 of the rib 224 and two opposite faces 1193 of the two thumb-shaped protrusions 1191, 1192 are all planar, a bigger turning force should be applied to the audio plug 22 when the audio plug 22 need to be taken out of the housing 11. Moreover, force is mainly applied to the audio plug 22 in the axial direction rather than in turning direction when the audio plug 22 mates to the complementary connector, thereby, in normal use, the second limiting member 119 engaging with the second retaining member 224 can prevent the audio plug 22 from rotating. In such a way, the audio plug 22 is reliably secured in the receiving cavity 117.

When the audio plug 22 of the electrical connector 100 need to be taken out to be reworked or replaced, a bigger turning force is firstly applied to the audio plug 22 to release the second retaining member 224 from the second limiting member 119. Then, the audio plug 22 is pulled out of the receiving cavity 117 of the housing 11 along the rear-to-front direction. Therefore, the audio plug 22 can be reworked or replaced individually. In addition, if the contacts can not pass the test, just pull them out and replace them. By this way, the electrical connector 100 in accordance with the present invention need not to be discarded entirely only for a part thereof being unqualified, thus, the manufacturing cost could be reduced.

The first limiting member and the second limiting member can be interchanged each other, and there is no difference in effect from the structure disclosed in the first embodiment. Moreover, the first retaining member and the first limiting member can be interchanged each other accompany with the second retaining member and the second limiting member being interchanged each other. That is, the first limiting member is two projections axially arranged on the inner surface of the cavity and with space therebetween, the first retaining member only has the second projecting loop as mentioned in the first embodiment, the second limiting member is a rib with the same configuration as described in the first embodiment projected from the inner surface of the cavity, the second retaining member is two thumb-shaped protrusions projecting in traversal direction perpendicular to the axial direction from the rear portion of the audio plug and having space therebetween. In addition, the angle formed between the two perpendicular bisectors of the first and second limiting members is not only a right angle, but also other angles, even an angle of zero degree. But it is noted that the angle of the perpendicular bisector of the second limiting member and the direction along which the second retaining member extending can not be zero degree when the audio plug is completely inserted into the receiving cavity, otherwise the audio plug could not secured in the cavity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

a housing comprising a receiving cavity, a first limiting member projecting into the receiving cavity and a second limiting member projecting into the receiving cavity; and an audio plug being received in the receiving cavity and having a mating portion, a first retaining member extending from the mating portion, a rear portion opposite to the mating portion, and a second retaining member;

wherein when the audio plug is at a first angle, the first retaining member engages with the first limiting member for allowing insertion of the audio plug into the receiving cavity;

when the audio plug is rotated to a second angle, the first limiting member is restricted and received in the first retaining member and the second retaining member engages with the second limiting member.

2. The plug connector as claimed in claim 1, wherein the first limiting member comprises a projection projecting from the inner surface of the receiving cavity for engaging with the first retaining member.

3. The plug connector as claimed in claim 2, wherein the first retaining member comprises a first and a second projecting loops arranged along an axis of the audio plug for engaging with the projection of the first limiting member, and a groove defined between the first and second projecting loops for receiving the projection.

4. The plug connector as claimed in claim 3, wherein the second projecting loop defines a planar surface thereon corresponding to the projection of the first limiting member.

5. The plug connector as claimed in claim 3, wherein a diameter of each of the projecting loops is substantially equal to a diameter of the receiving cavity, and a width of the groove is substantially equal to a width of the projection of the first limiting member.

6. The plug connector as claimed in claim 1, wherein the second limiting member comprises a protrusion projecting from the inner surface of the receiving cavity for engaging with the second retaining member.

7. The plug connector as claimed in claim 6, wherein said second retaining member comprises a rib for engaging with the protrusion of the second limiting member.

8. An electrical connector comprising:

a housing comprising a first portion defining a plurality of passageways, a second portion defining a receiving cavity, a first limiting member projecting into the receiving cavity and a second limiting member projecting into the receiving cavity;

a plurality of contacts being received in the passageways of the first portion and each having a contacting portion and a tail portion extending from the contacting portion; and an audio plug being received in the receiving cavity of the second portion and having a mating portion, a first retaining member extending from the mating portion, a rear portion opposite to the mating portion, and a second retaining member;

wherein when the audio plug is at a first angle, the first retaining member engages with the first limiting member for allowing insertion of the audio plug into the receiving cavity;

when the audio plug is rotated to a second angle, the first limiting member is restricted and received in the first retaining member and the second retaining member engages with the second limiting member.

9. An electrical connector comprising:

an insulative housing defining a through hole;

a telescopic plug received in the through hole and defining an annular groove thereof;

first means formed in the through hole and received in the annular groove for allowing the plug to axially pass therethrough at a first angle while said first means being retained in the annular groove after rotation to a second angle; and second means integrally formed on both said plug and in said through hole for retaining the plug in the through hole in position angularly once said plug is rotated to said second angle.

10. The connector as claimed in claim 9, wherein said second means includes a pair of protrusions formed in the through hole of the housing, and a rib formed on the plug.

11. The connector as claimed in claim 10, wherein said pair of protrusions are spaced from the first means axially.

12. The connector as claimed in claim 11, wherein said pair of protrusions and said first means are offset from each other angularly so as not to be aligned with each other axially.

13. The connector as claimed in claim 9, wherein said first means includes a pair of projections diametrically oppositely formed on an interior surface of the through hole of the housing.

* * * * *